US008453718B2

(12) United States Patent
Lee et al.

(10) Patent No.: US 8,453,718 B2
(45) Date of Patent: Jun. 4, 2013

(54) SINTERED HEAT PIPE, MANUFACTURING METHOD THEREOF AND MANUFACTURING METHOD FOR GROOVE TUBE THEREOF

(75) Inventors: Ke-Chin Lee, Taipei (TW); Shu-Lung Chung, Taoyuan County (TW)

(73) Assignee: Zhongshan Weiqiang Technology Co., Ltd., Sanxiang Town, Zhongshan, Guangdong (CN)

( * ) Notice: Subject to any disclaimer, the term of this patent is extended or adjusted under 35 U.S.C. 154(b) by 794 days.

(21) Appl. No.: 12/615,714

(22) Filed: Nov. 10, 2009

(65) Prior Publication Data

US 2011/0024098 A1 Feb. 3, 2011

(30) Foreign Application Priority Data

Jul. 31, 2009 (TW) ..... 98125983 A
Aug. 21, 2009 (TW) ..... 98128202 A

(51) Int. Cl.
*F28D 15/00* (2006.01)
*F28F 1/42* (2006.01)
*H05K 7/20* (2006.01)
*B21D 53/00* (2006.01)

(52) U.S. Cl.
USPC .... 165/104.26; 165/179; 361/700; 29/890.02

(58) Field of Classification Search
USPC ..... 165/104.26, 179; 361/700; 29/890.02
See application file for complete search history.

(56) References Cited

U.S. PATENT DOCUMENTS 2,779,222 A * 1/1957 Edwards ..... 72/113
2,814,470 A * 11/1957 Peterson ..... 165/170
4,196,504 A * 4/1980 Eastman ..... 29/890.032
4,938,282 A * 7/1990 Zohler ..... 165/133
7,316,264 B2 1/2008 Lai et al.
2006/0112558 A1* 6/2006 Lorenz et al. ..... 29/890.144
2006/0175044 A1* 8/2006 Lee et al. ..... 165/104.26
2006/0283576 A1* 12/2006 Lai et al. ..... 165/104.26
2007/0035927 A1* 2/2007 Erturk et al. ..... 361/700
2007/0163749 A1* 7/2007 Miyahara ..... 165/80.3

FOREIGN PATENT DOCUMENTS

CN 201053839 Y 4/2008
JP 60-042593 A 3/1985
JP 62-98200 5/1987
JP 2002-90086 3/2002
JP U3110922 A 5/2005
JP 2005-161357 6/2005
JP 2008-23536 2/2008
JP 2009-068787 A 4/2009
JP 2009-115346 5/2009
TW 273936 Y 8/2005
TW 278870 Y 10/2005

* cited by examiner

*Primary Examiner* — Frantz Jules
*Assistant Examiner* — Henry Crenshaw
(74) *Attorney, Agent, or Firm* — Rabin & Berdo, P.C.

(57) ABSTRACT

A sintered heat pipe, a manufacturing method thereof and a manufacturing method for a groove tube thereof are provided. The sintered heat pipe includes a groove tube, a sintered powder layer and a working fluid. The groove tube has a plurality of grooves and a first end and a second end opposite to the first end. Each groove extends along an axial direction of the groove tube. The first end and the second end are closed. The sintered powder layer is formed on an inside wall of the groove tube, and the groove tube is filled with the working fluid. The size of each powder in the sintered powder layer is greater than a width of each of the grooves.

3 Claims, 7 Drawing Sheets

SINTERED HEAT PIPE, MANUFACTURING METHOD THEREOF AND MANUFACTURING METHOD FOR GROOVE TUBE THEREOF

This application claims the benefit of Taiwan applications Serial No. 98125983, filed Jul. 31, 2009 and Serial No. 98128202, filed Aug. 21, 2009, the subject matter of which are incorporated herein by reference.

BACKGROUND OF THE INVENTION

1. Field of the Invention

The invention relates in general to a sintered heat pipe, a manufacturing method thereof and a manufacturing method for a groove tube thereof, and more particularly to a sintered heat pipe with grooves, a manufacturing method thereof, and a manufacturing method for a groove tube thereof.

2. Description of the Related Art

A heat pipe, especially a sintered heat pipe, is an apparatus having the highly conductive ability. The conventional heat pipe includes a capillary structure and a metal tube. The capillary structure is in contact with the metal tube and is usually formed on an inside wall of the metal tube. A vapor channel is defined on the inside surface of the capillary structure.

As is well known in the art, one end of the heat pipe absorbs the heat from a heat source and functions as a vaporizing sector, and the other end thereof transfers the heat to a cold source so that a liquid working fluid is formed by condensing. The liquid working fluid is processed by the capillary absorption function of the capillary structure and returns to the hot junction from the cold junction. The liquid working fluid is heated and vaporized into the vaporized working fluid in the hot junction, and the vaporized working fluid flows to the cold junction through the vapor channel and then condensed into the liquid working fluid. The tube wall of the capillary structure may be formed with a plurality of grooves so that its conductive effect becomes especially good, the flow-guide effect of the working fluid is enhanced, and the conductive efficiency is thus enhanced.

In the manufacturing methods of Japanese Patent No. 3110922 (Taiwan patent application serial No. 094202974) and U.S. Pat. No. 7,316,264 (Taiwan patent application serial No. 094210450), a copper tube having a grooved inside wall is provided. The copper tube after being sectioned has a first end and a second end. The first end is firstly closed, then the copper tube is filled with the metal powders, and then the metal powders are sintered. Next, the working fluid is injected into the copper tube and the air inside the copper tube is pumped out. At last, the second end is closed.

However, the metal powders have different sizes so that the too-small metal powders fall into the grooves. In Japanese Patent No. 3110922 (Taiwan patent application serial No. 094202974), the metal powders falling into the grooves after sintering are fixed to the grooves. This forms the congestion to the liquid working fluid, which flows from the cold junction to the hot junction, and deteriorates the conductive effect of the heat pipe.

In U.S. Pat. No. 7,316,264 (Taiwan patent application serial No. 094210450), the metal powders have to be greater than the diameter of the inside groove of the wall of the groove tube. However, this patent does not mention how to achieve this object. Unless a special manufacturing method is developed, it is impossible to make all the metal powders achieve this object according the typical method.

In addition, if the width of the groove is too wide, the capillary phenomenon after sintering becomes non-obvious, and the heat dissipation effect is deteriorated.

SUMMARY OF THE INVENTION

The invention is directed to a sintered heat pipe, a manufacturing method thereof and a manufacturing method for a groove tube thereof. In the sintered heat pipe, powders of a sintered powder layer are sieved out, so that the sizes of the powders are greater than widths of grooves in the sintered heat pipe. Thus, the number of powders falling into the grooves may be decreased so that a working fluid can flow in the grooves smoothly without any congestion.

According to a first aspect of the present invention, a manufacturing method for a sintered heat pipe is provided. The manufacturing method includes the steps of: providing a groove tube having a plurality of grooves, each of which extends along an axial direction of the groove tube; sectioning the groove tube, wherein the sectioned groove tube has a first end and a second end opposite to the first end; closing the first end; sieving out a plurality of powders, wherein an outer diameter of each of the powders is greater than a width of each of the grooves; inserting a rod into the sectioned groove tube, wherein an outer diameter of the rod is smaller than an inner diameter of the sectioned groove tube; filling the sectioned groove tube with the powders, wherein a space between the rod and an inside wall of the sectioned groove tube is filled with the powders; sintering the powders to form a sintered powder layer on the inside wall of the sectioned groove tube; removing the rod; filling the sectioned groove tube with a working fluid; pumping out air in the sectioned groove tube; and closing the second end.

According to a second aspect of the present invention, a manufacturing method for a groove tube of a sintered heat pipe is provided. The manufacturing method includes the steps of: providing a hollow tube which is surround-like; unbending the hollow tube; stretching the hollow tube; and using a model cylinder having a plurality of teeth to form a plurality of grooves, corresponding to the teeth, on an inside wall of the hollow tube and thus to form the groove tube. An extending direction of each of the grooves is substantially parallel to an extending direction of the groove tube.

According to a third aspect of the present invention, a sintered heat pipe is provided. The sintered heat pipe includes a groove tube, a sintered powder layer and a working fluid. The groove tube has a plurality of grooves, a first end and a second end opposite to the first end. The grooves are formed on an inside wall of the groove tube. Each of the grooves extends along an axial direction of the groove tube. The first end and the second end are closed. The sintered powder layer is formed on an inside wall of the groove tube. The groove tube is filled with the working fluid.

The invention will become apparent from the following detailed description of the preferred but non-limiting embodiments. The following description is made with reference to the accompanying drawings.

DETAILED DESCRIPTION OF THE INVENTION

The present invention will be apparent from the following detailed description, which proceeds with reference to the accompanying non-restrictive drawings and several non-restrictive embodiments, wherein the same references relate to the same elements. Furthermore, unessential elements are omitted from the drawings to make the technological features of the invention become clearer.

First Embodiment

Figure 1:
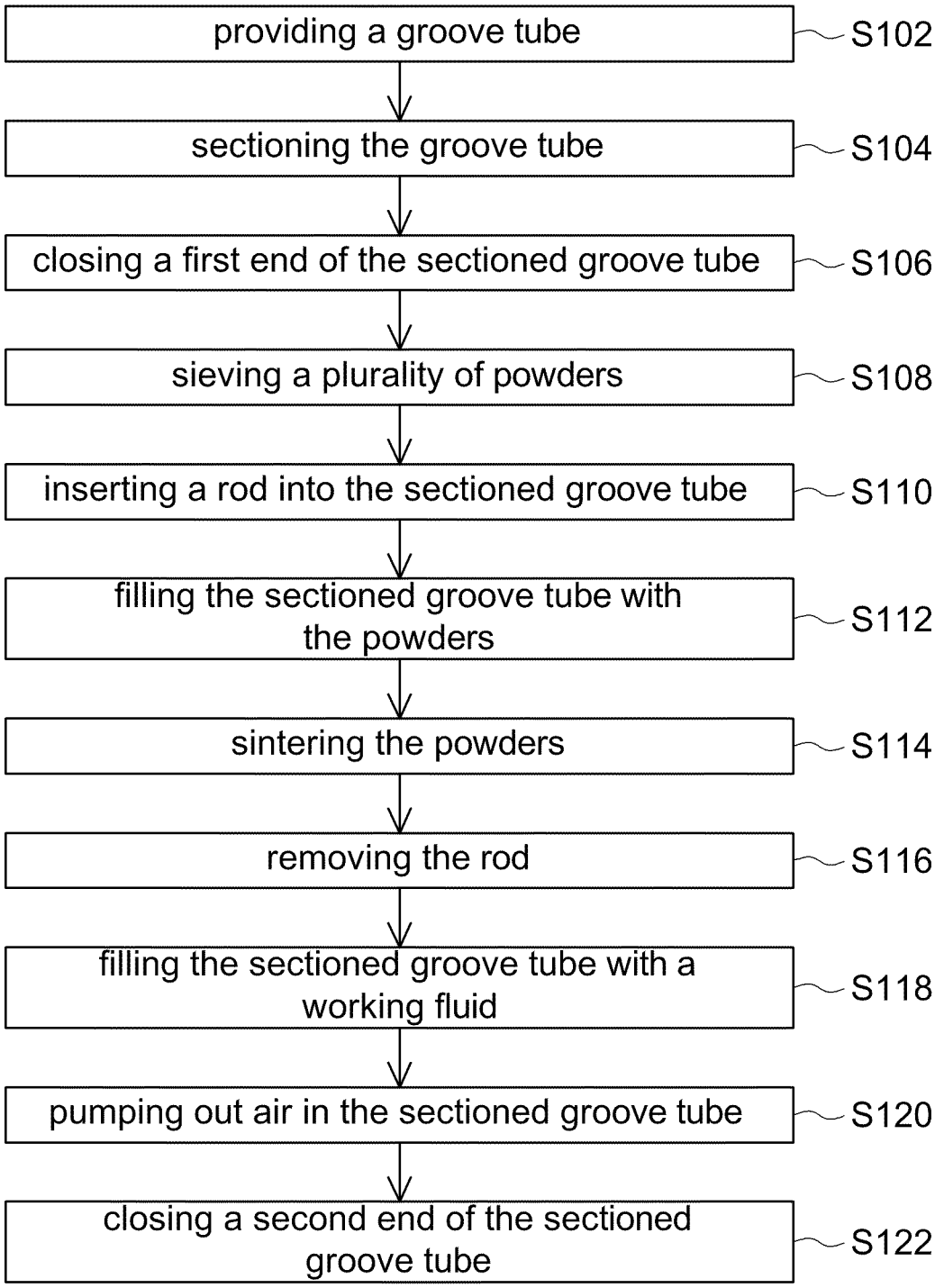
FIG. 1 is a flow chart showing a manufacturing method for a sintered heat pipe according to a first embodiment of the invention.

Please refer to FIGS. 1 and 2A to 2F simultaneously. FIG. 1 is a flow chart showing a manufacturing method for a sintered heat pipe according to a first embodiment of the invention. FIGS. 2A to 2F are schematic illustrations showing the manufacturing method for the sintered heat pipe according to the first embodiment of the invention.

Figure 2A:
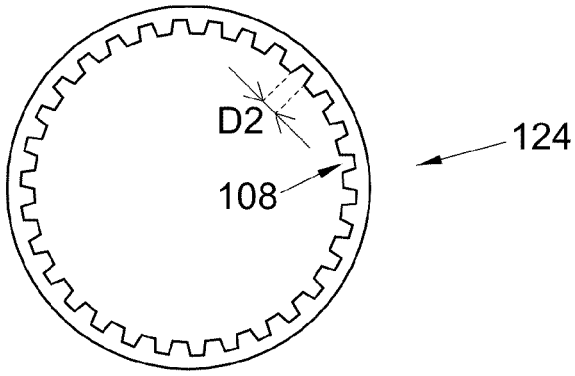
FIGS. 2A to 2F are schematic illustrations showing the manufacturing method for the sintered heat pipe according to the first embodiment of the invention.

In step S102, as shown in FIG. 2A, a groove tube 124 is provided. FIG. 2A is a cross-sectional view showing the groove tube 124 having several grooves 108, each of which extends along an axial direction of the groove tube 124. The material of the groove tube 124 may be copper or any other metal, for example.

Preferably, but without limitation, the number of the grooves 108 is 80 or more than 80, and a width of each groove 108 is smaller than 0.1 mm.

Figure 2B:
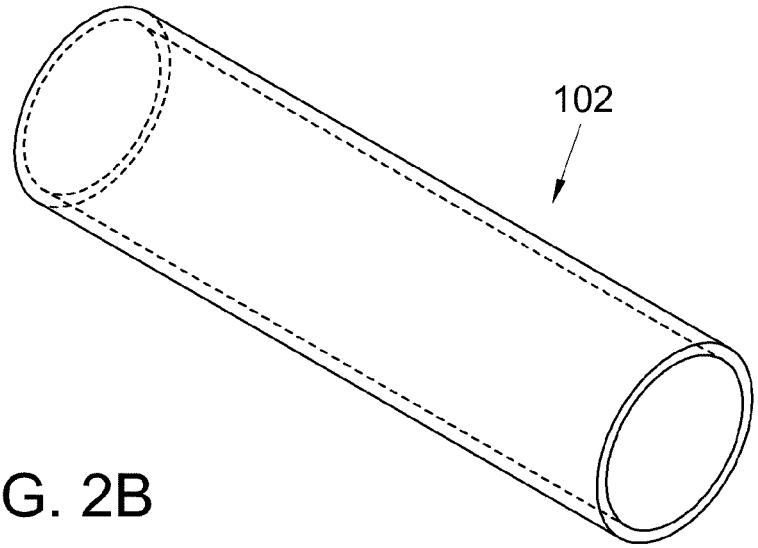
Figure 2C:
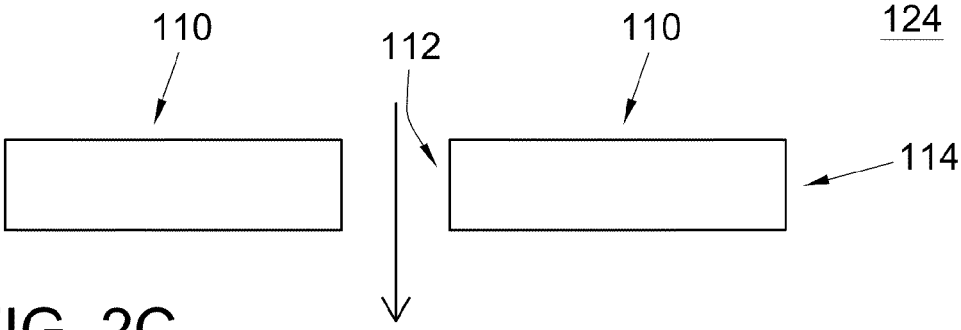

In another aspect, the step S102 may include the following two sub-steps. In the first sub-step, a hollow tube 102 is provided, as shown in FIG. 2B, wherein the material of the hollow tube 102 is copper or any other metal.

Figure 3:
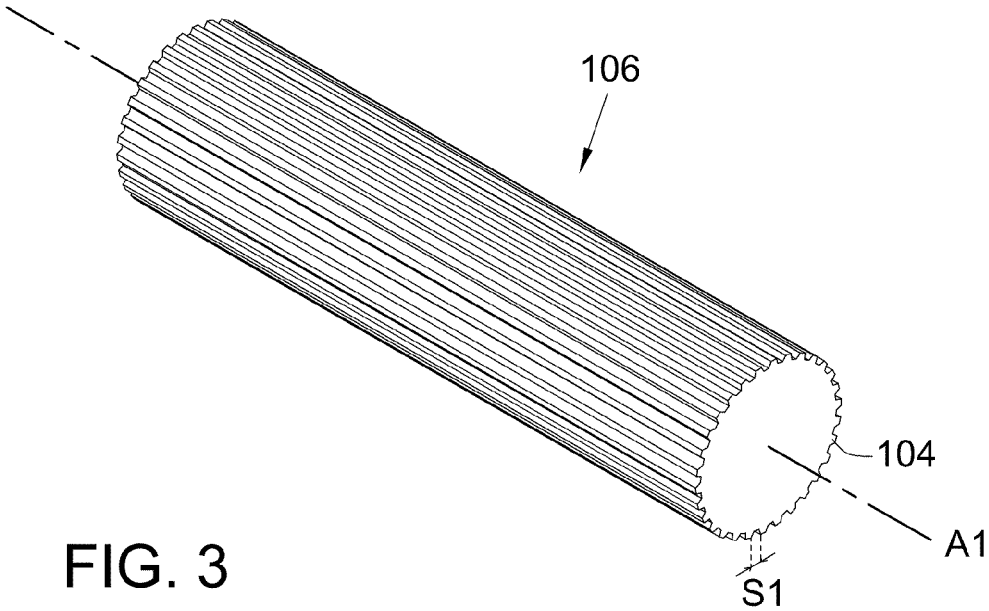
FIG. 3 is a schematic illustration showing the manufacturing of a model cylinder of the groove of FIG. 2A.

FIG. 3 is a schematic illustration showing the manufacturing of a model cylinder 106 of the groove of FIG. 2A. In the second sub-step, as shown in FIG. 3, the model cylinder 106 with several teeth 104 is used, and several grooves 108 corresponding to the teeth 104 are formed on the inside wall of the hollow tube 102 by way of pressing, for example, so that the groove tube 124 shown in FIG. 2A is formed. The model cylinder 106 may be formed by mechanical machining or chemical etching.

Referring next to FIG. 3, the teeth 104 surround a center axis A1 of the model cylinder 106 and are disposed on the outside wall of the model cylinder 106. Because the extending direction of the tooth 104 is substantially parallel o the extending direction of the model cylinder 106, the extending direction of the machined groove 108 is substantially parallel to the extending direction of the hollow tube 102.

Preferably but non-restrictively, the number of the teeth 104 may be 80 or more than 80. The height of the tooth 104 is not particularly restricted, and the gap S1 between the neighboring two of the teeth 104 is also not particularly restricted. So, the gaps S1 may be substantially the same or different from one another.

In addition, the width of each tooth may be smaller than 0.1 mm. Because the number and the shape of the machined grooves 108 correspond to the teeth 104, the width D2 of the groove 108 may be smaller than 0.1 mm.

Then, in step S104, as shown in FIG. 2B, the groove tube 124 is sectioned. For example, the groove tube 124 is sectioned to form several sections. The sectioned groove tube 110 has a first end 112 and a second end 114 opposite to the first end 112.

Then, in the step S106, the first end 112 of the groove tube 110 is closed. For example, the aperture of the first end 112 is first reduced, and then the first end 112 is closed by way of spot welding.

Next, in step S108, a plurality of powders 122 (see FIG. 2E) is sieved out. The material of the powder 122 is, for example, metal. The outer diameter of each of the powders is almost greater than the width D2 (see FIG. 2A) of the groove 108.

Figure 4:
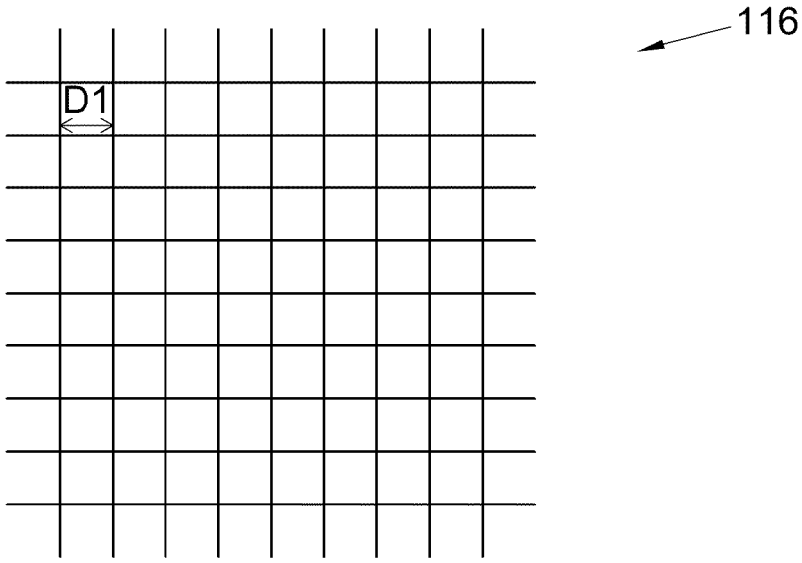
FIG. 4 is a schematic illustration showing a filter element according to the embodiment of the invention.

FIG. 4 is a schematic illustration showing a filter element according to the embodiment of the invention. In the step S108, a filter element, such as a mesh 116, as shown in FIG. 4, may be used to sieve out the powders 122. The inner diameter D1 of the hole of the mesh 116 is greater than the width D2 of the groove 108 such that the outer diameter of the powder 122 left on the mesh 116 is greater than the width D2 of the groove 108. The powders 122 with the desired sizes may be sieved out, using the mesh 116, from the mixed powders with unequal sizes, so it is very convenient. In detail, the powders 122 of this embodiment need not to be manufactured using other particular manufacturing processes. The powders 122 with the desired sizes may be sieved out, using the mesh 116 of this embodiment, from the typical mixed powders even having the unequal powder sizes.

Figure 2D:
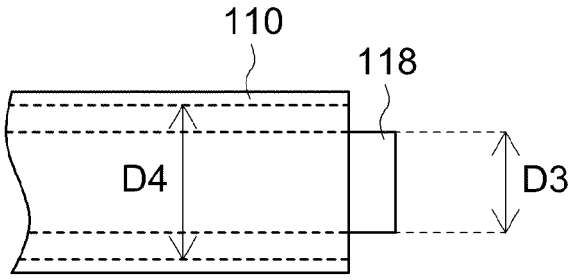

Then, in step S110, as shown in FIG. 2D, a rod 118 is inserted into the groove tube 110. The outer diameter D3 of the rod 118 is smaller than the inner diameter D4 of the groove tube 110.

Figure 2E:
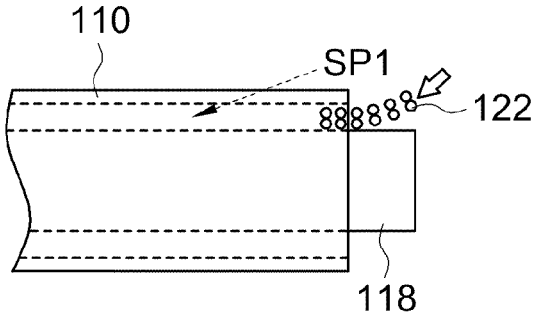

Next, in step S112, as shown in FIG. 2E, the space SP1 between the rod 118 and the inside wall of the groove tube 110 is filled with the powders 122.

Figure 2F:
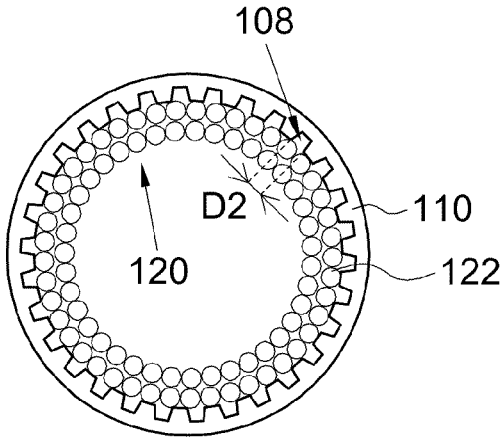

Then, in step S114, the powders 122 are sintered to form the sintered powder layer 120 on the inside wall of the groove tube 110, as shown in FIG. 2F.

Next, in step S116, the rod 118 is removed.

In this embodiment, as shown in FIG. 2F, the outer diameters of most of the powders 122 are greater than the width D2 of the groove 108, so the number of the powders 122 falling down to the groove 108 may be decreased. Thus, during the working process of the groove tube 124, the working fluid can flow smoothly in the groove 108 without congestion so that the conductive effect can be enhanced.

In FIG. 2F, although the powders 122 has the circular external shape, this circular external shape does not intend to limit the scope of the invention. Those skilled in the art should understand that the powders 122 may have an arbitrary external shape.

Then, in step S118, the groove tube 110 is filled with the working fluid (not shown).

Next, in step S120, the air of the groove tube 110 is pumped out.

Then, in step S122, the second end 114 (see FIG. 2C) of the groove tube 110 is closed. For example, the aperture of the second end 114 is firstly reduced, and then the second end 114 is closed by way of spot welding. At this time, the sintered heat pipe according to the first embodiment of the invention is finished.

In the sintered heat pipe of this embodiment, 80 grooves 108 are sufficient so that the width D2 of the groove is sufficiently small (e.g., smaller than 0.1 mm) and the powders 122 cannot easily fall into the grooves 108. Consequently, the conductive effect of the sintered heat pipe may be enhanced. In detail, the number of grooves of the conventional heat pipe ranges between 55 and 57, and the heat dissipating of the heat pipe is about 25 watts according to the experimental result. In the sintered heat pipe according to this embodiment of the invention, the heat dissipating ability thereof is about 35 watts. So, the effect of the embodiment of the invention is sufficiently improved.

In addition, the external shape of the sintered heat pipe of this embodiment may be further shaped. For example, after the step S122, the manufacturing method for the sintered heat pipe may further include the step of applying a radial force (not shown) to the groove tube 110 to flatten the groove tube 110. Alternatively, after the step S122, the manufacturing method for the sintered heat pipe may further include the step of bending the groove tube 110 into a predetermined trend, and then applying a radial force to the groove tube 110 to flatten the groove tube 110.

Second Embodiment

Figure 5:
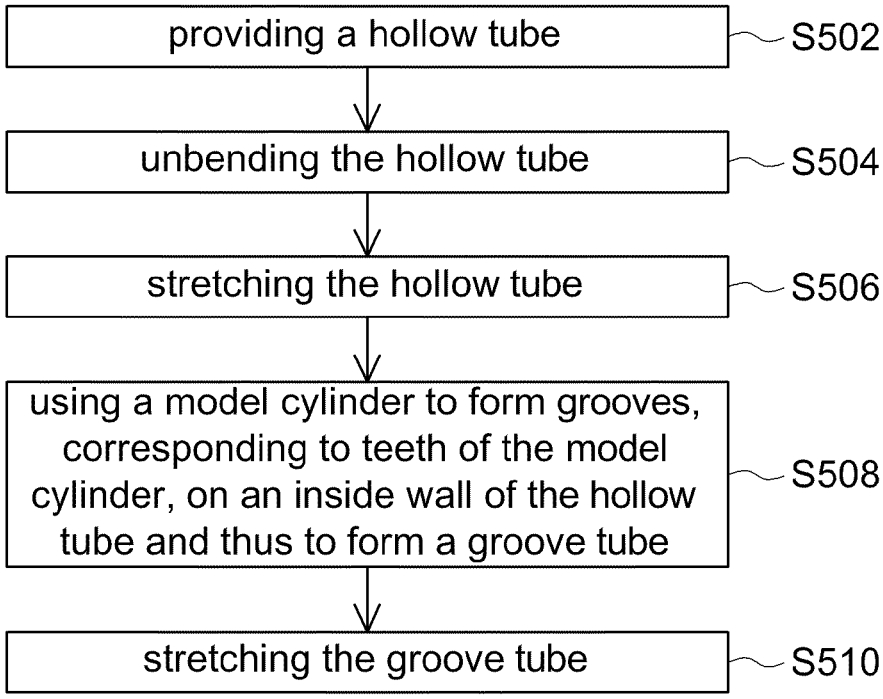
FIG. 5 is a flow chart showing a manufacturing method for a groove tube of a sintered d heat pipe according to a second embodiment of the invention.

FIG. 5 is a flow chart showing a manufacturing method for a groove tube of a sintered heat pipe according to a second embodiment of the invention. The same references in the first and second embodiments relate to the same elements, so detailed descriptions of the repeated elements will be omitted.

Figure 6:
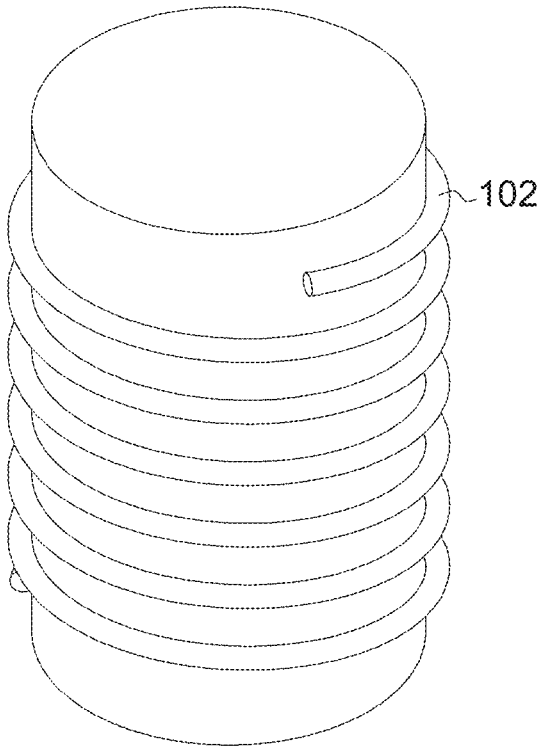
FIG. 6 is a hollow tube according to a second embodiment of the invention.
Figure 7:
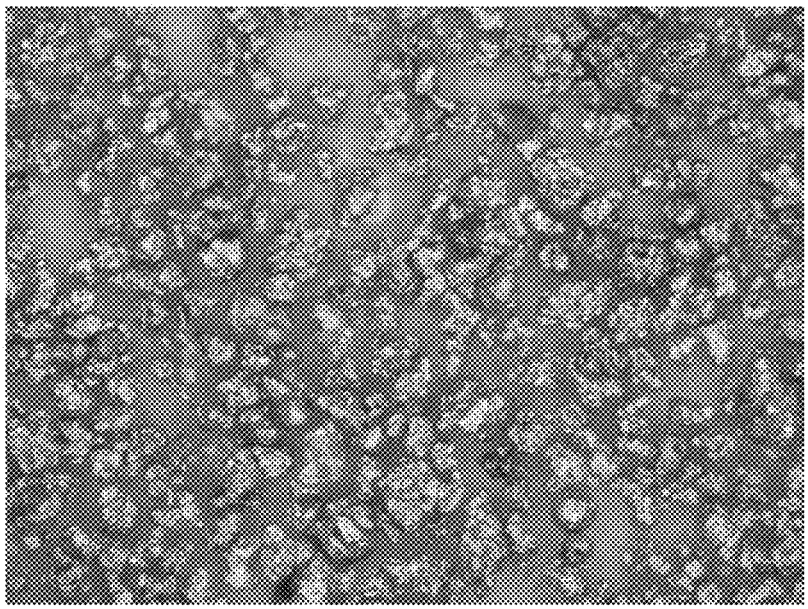
FIG. 7 is an appearance view of the powders before being sieved out according to one embodiment of the invention.
Figure 8:
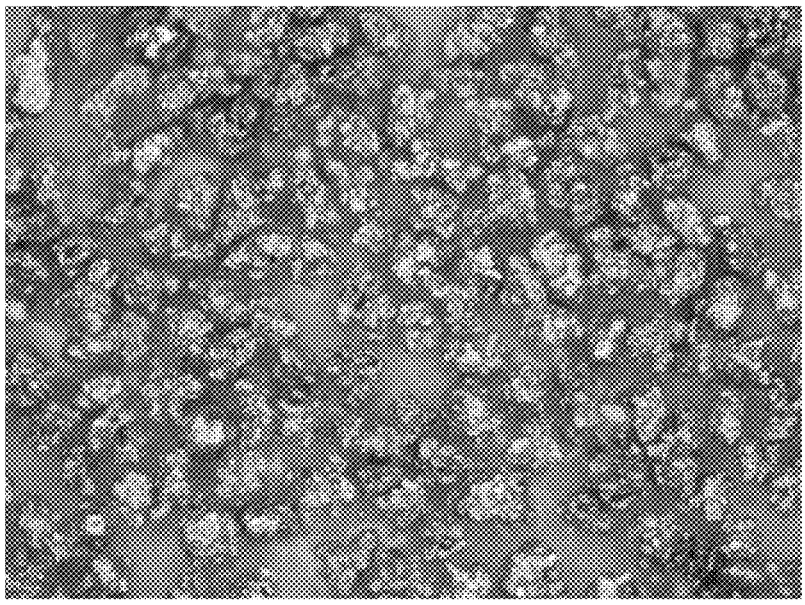
FIG. 8 is an appearance view of the powders after being sieved out according to one embodiment of the invention.
Figure 9:
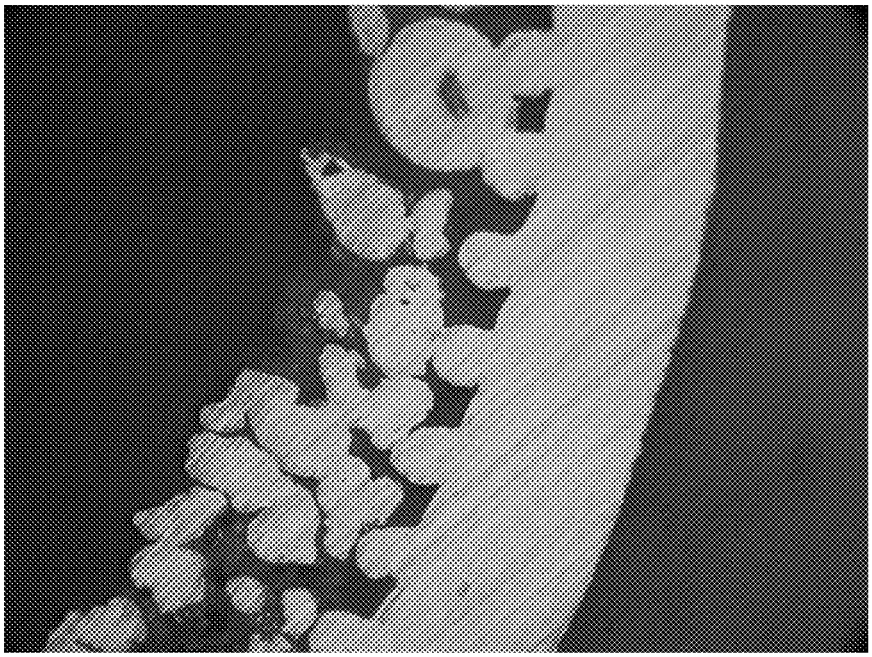
FIG. 9 is an appearance view of powders difficult to fall into the grooves according to one embodiment of the invention.
Figure 10:
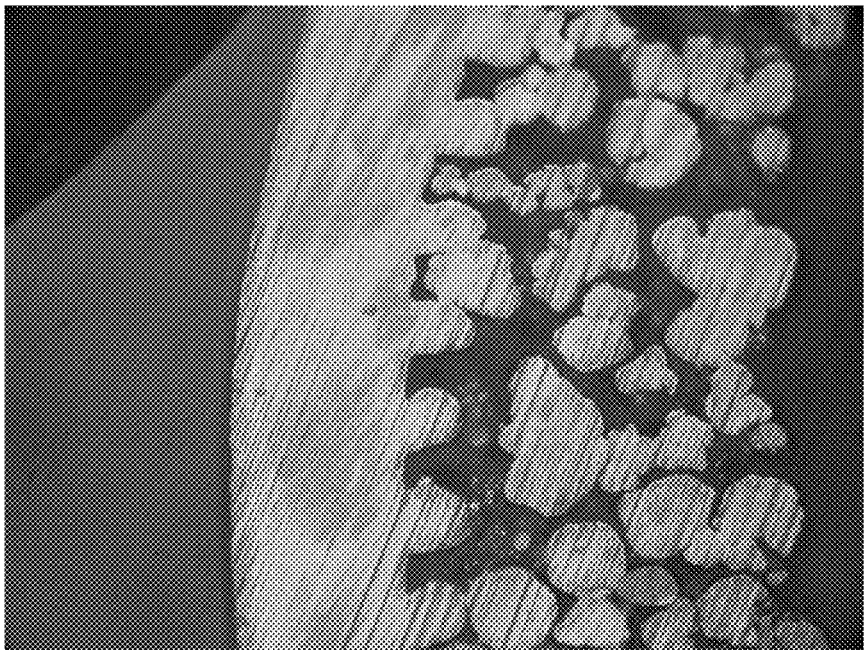
FIG. 10 is an appearance view of a few powders smaller than the width of the groove according to one embodiment of the invention.

In step S502, As illustrated in FIG. 6, a hollow tube 102 is provided. The hollow tube 102 is a thread around a reel, and the material thereof is, for example, copper or any other metal material.

Then, in step S504, the hollow tube is pulled from the reel and then unbent.

Next, in step S506, the hollow tube is stretched to reduce the diameter of the hollow tube.

Then, in step S508, it is possible to use the model cylinder 106 of FIG. 3 to form a plurality of grooves 108, corresponding to the teeth 104, on the inside wall of the hollow tube and thus to form the groove tube 124 shown in FIG. 2A.

In the step S506, the temperature of the hollow tube after the machining and deformation rises, so the formability of the grooves 108 of the hollow tube in the step S508 may be enhanced.

Then, in step S510, the groove tube 124 may be further stretched so that the diameter of the groove tube 124 satisfies the predetermined size.

In detail, in order to facilitate the machining of the model cylinder 106 in the step S506, the diameter of the hollow tube may not be stretched to satisfy the predetermined size. In this case, the groove tube 124 is stretched in the step S510 so that the final diameter of the groove tube 124 satisfies the predetermined size. However, this does not intend to restrict the invention, and the step S510 may be omitted according to the actual condition.

In addition, the manufacturing method for the sintered heat pipe may further include, after the step S510, the step of detecting whether the groove tube 124 is damaged or not. If the groove tube 124 is damaged, the damaged portion may be recorded, and this portion may be cut off in the step S104 of FIG. 1. Then, the step of cleaning the groove tube 124 may be performed to remove the grease and oxidation impurities.

The sintered heat pipe, the manufacturing method thereof and the manufacturing method for the groove tube thereof according to the embodiments of the invention have many advantages, some of which will be listed in the following.

First, the powders need not to be particularly manufactured using other manufacturing processes. The powders with the desired sizes may be sieved out, using the mesh of this embodiment, from the typical mixed powders even having the unequal powder sizes.

Second, the powders with the desired sizes may be sieved out, using the mesh of this embodiment, from the mixed powders having the unequal powder sizes. So, it is very convenient.

Third, because the outer diameters of most of the powders are greater than the widths of the grooves, the powders cannot easily fall into the grooves. Thus, during the working process of the groove tube, the working fluid can flow smoothly in the groove without congestion so that the conductive effect can be enhanced. However, there are a few powders smaller than the width of the groove, and the sintered powders are sunk into the grooves so that a few bad products with the deteriorated heat conductive effect are formed.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A manufacturing method for a sintered heat pipe, comprising:

providing a hollow copper tube which is surround-like;

unbending the hollow copper tube;

stretching the hollow copper tube;

using a model cylinder having a plurality of teeth to form a plurality of grooves, corresponding to the teeth, on an inside wall of the copper hollow tube and thus to form a groove copper tube, wherein each groove extends along an axial direction of the groove copper tube, and the number of the teeth is greater than or equal to 80;

stretching the groove copper tube after forming the grooves, such that a width of each of the grooves is smaller than 0.1 mm;

detecting whether the groove copper tube is damaged or not, wherein if the groove copper tube is damaged, a damaged portion is recorded;

cleaning the groove copper tub to remove any grease and oxidation impurities;

sectioning the groove copper tube after the step of detecting whether the groove copper tube is damaged or not, wherein the sectioned groove copper tube has a first end and a second end opposite to the first end and the damaged portion is cut off;

closing the first end;

sieving out a plurality of copper powders using a mesh having holes for decreasing the number of the powders to fall down to the grooves, wherein an inner diameter of each of the holes of the mesh is greater than the width of each groove, and an outer diameter of each of the copper powders is greater than the width of each of the grooves in order to decrease the number of the powders to fall down to the grooves;

inserting a rod into the sectioned groove copper tube, wherein an outer diameter of the rod is smaller than an inner diameter of the sectioned groove copper tube;

filling the sectioned groove copper tube with the copper powders, wherein a space between the rod and an inside wall of the sectioned groove copper tube is filled with the copper powders;

sintering the copper powders to form a sintered copper powder layer on the inside wall of the sectioned groove copper tube;

removing the rod;

filling the sectioned groove copper tube with a working fluid;

pumping out air in the sectioned groove copper tube; and closing the second end.

2. The method according to claim 1, wherein the model cylinder is manufactured by way of mechanical machining or chemical etching.

3. A sintered heat pipe, comprising:

a groove copper tube having a plurality of grooves, a first end and a second end opposite to the first end, wherein the grooves are formed on an inside wall of the groove copper tube, each of the grooves extends along an axial direction of the groove copper tube, the first end and the second end are closed, the number of the grooves is greater than or equal to 80, and a width of each of the grooves is smaller than 0.1 mm;

a sintered copper powder layer formed on the inside wall of the groove copper tube; and a working fluid filling the groove copper tube, wherein, the sintered copper powder layer is formed by sintering a plurality of copper powders, which is sieved out by a mesh having holes, and an inner diameter of each of the holes of the mesh is greater than a width of each of the grooves in order to decrease the number of the powders to fall down to the grooves.

* * * * *